United States Patent [19]

Harris

[11] Patent Number: 4,479,081

[45] Date of Patent: Oct. 23, 1984

[54] STEP MOTOR DRIVE

[75] Inventor: Samuel C. Harris, Waynesboro, Va.

[73] Assignee: General Electric Company, Fort Wayne, Ind.

[21] Appl. No.: 494,350

[22] Filed: May 13, 1983

[51] Int. Cl.[3] ..... H02K 29/04

[52] U.S. Cl. ..... 318/696; 318/685; 318/7; 360/73

[58] Field of Search ..... 242/186, 187, 191, 200; 318/7, 696, 685; 360/73, 74.1, 74.2, 72.3

[56] References Cited

U.S. PATENT DOCUMENTS 3,764,087 10/1973 Paananen et al. ..... 242/186

3,984,868 10/1976 Ragle et al. ..... 242/191 X 4,125,881 11/1978 Eige et al. ..... 360/50

4,398,227 8/1983 Anderson ..... 360/71

*Primary Examiner*—B. Dobeck

*Assistant Examiner*—Saul M. Bergmann

*Attorney, Agent, or Firm*—John M. Stoudt

[57] ABSTRACT

Use of a programmable source of stepping pulses to control the speed of linear movement of a material from a supply spool to a takeup spool wherein feedback signals provide an indication of the angular velocity of the supply spool and a function table provides information on the rate of stepping pulses to be applied to the takeup spool.

15 Claims, 4 Drawing Figures

$a_1 + a_2$ IS CONSTANT $V = r_1 \omega_1 = r_2 \omega_2$

STEP MOTOR DRIVE

BACKGROUND OF THE INVENTION

The present invention is related to controlling the linear movement of a web or tape between spools or reels and particularly to controlling the transport of ribbon past a print head in connection with impact printing of symbols on a record medium.

This application is related to my copending commonly assigned U.S. patent application Ser. No. 399,129 filed July 16, 1982 and Ser. No. 399,216 filed July 19, 1982 and Ser. No. 399,130 filed July 16, 1982 and Ser. No. 504,959 filed June 16, 1983. The disclosure of these related applications is hereby incorporated by reference.

A common form of linear speed control for a moving web employs a constant speed capstan pinch roller drive, as used, for example, in tape or ribbon transports. In such transports where constant tape velocity is required, a special drive is required for the takeup reel and the payout reel as well as for the pinch roller drive in order to attain reasonable precision for the surface velocity of the tape. Added complications arise when the web has to be driven bidirectionally at high speed. Heretofore the use of a pinch roller has provided certain disadvantages, as for example, problems in maintaining the proper tension in the ribbon during movement, and the problem of proper tracking particularly where the ribbon is of fairly broad width.

Accordingly, one object of this invention is to provide an improved control for providing constant surface velocity of a moving web or tape.

A further object of this invention is to provide a tape drive requiring a lesser number of mechanical components and providing improved linear velocity control.

A further object of this invention is to provide a linear velocity control for use with an inked ribbon having a large width.

Briefly in accordance with one embodiment of the invention, step motors and a digital controller are employed to eliminate the capstan drive. By making use of the feedback pulses emitted from the payout step motor as it is pulled during tape movement, a closed loop digital system is provided to regulate the tape speed with sufficient accuracy for many applications as for example in high speed impact printing. Speed regulation is obtained by processing the feedback pulses to provide drive step pulses for a takeup step motor whose step rate is a function of the feedback pulse rate. The digital control uses a function table which is contained in a read only memory. This read only memory is addressed by the number of feedback pulses emitted during a sample number of takeup step pulses. The sample number and function table entries are determined by the accuracy and resolution requirements. While the control logic for this system might be implemented with common logic elements, that is gates, counters, etc., in one embodiment to be disclosed herein a microprocessor is provided.

BRIEF DESCRIPTION OF THE DRAWING

These as well as other objects and advantages of this invention will be better appreciated and understood by reference to the following detailed description of the presently preferred exemplary embodiments taken in conjunction with the accompanying drawings of which.

DESCRIPTION OF THE PREFERRED EMBODIMENT

Figure 1:
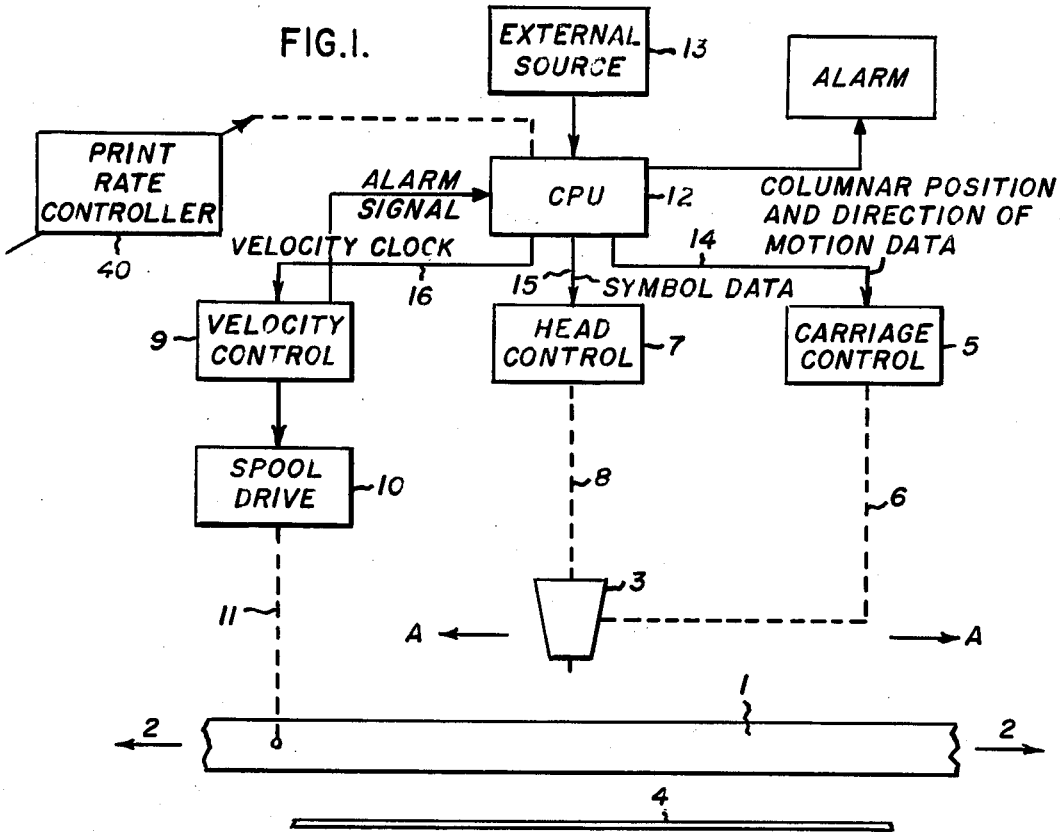
FIG. 1 illustrates schematically a tape transport arrangement for moving tape at a constant linear speed past a print head for effecting printing at desired column locations along the print line.

Referring to FIG. 1 there is shown a ribbon 1 required to be moved linearly at constant speed in either direction as indicated by 2 past a print head 3 such that upon the application of signals to print head 3 as for example in a wire matrix print head, individual print wires are actuated to impact a record medium 4 such as paper through the ribbon 1 to print desired symbols. In the arrangement shown in FIG. 1, movement of the print head 3 is controlled by carriage control 5 as shown through the coupling 6. Control of the print head 3 is carried out under the control of head control 7 through the coupling 8. Movement of the ribbon 1 is controlled by velocity control 9 acting through the spool drive unit 10 and the coupling 11. In one embodiment the controls 5, 7 and 9 comprise step motors acting through the interconnections 6, 8 and 11 as previously described under the control of pulses generated within blocks 5, 7 and 10 in response to data furnished from a central processor unit 12. Unit 12 responds to information received from data communication source 13 to provide column position and direction of motion data over link 14 to carriage control 5, to supply symbol data to the head control 7 over link 15 and to supply velocity data to velocity control 9 over link 16. In this manner, information received from the source 13 is processed to provide drive information to obtain the desired coordination of linear ribbon movement, linear velocity head movement and the proper impacting of print wires to print the desired symbols on the record medium at the desired columns through the ribbon 1.

Figure 2:
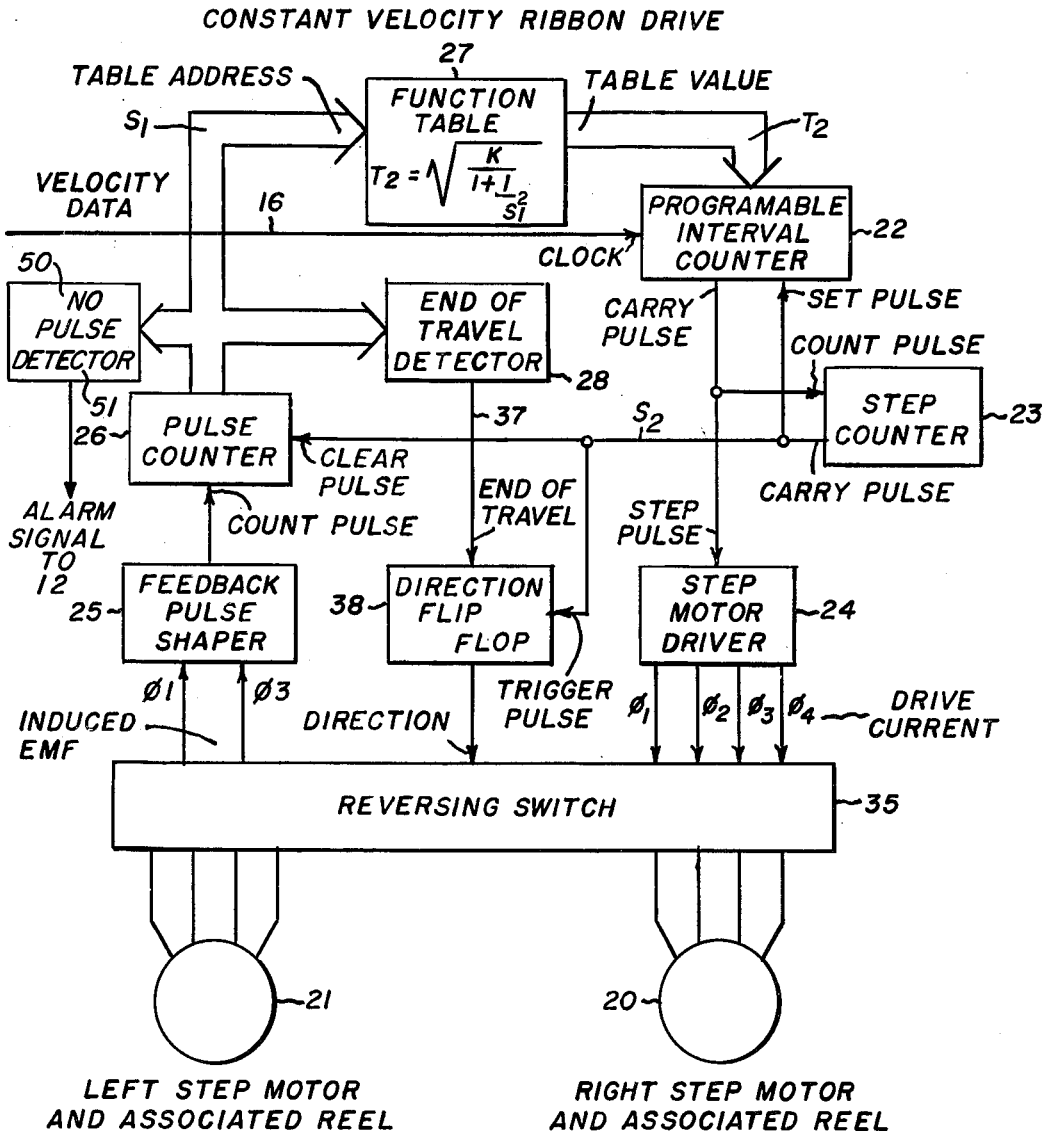
FIG. 2 illustrates in block diagram form one embodiment of the present invention.

Referring to FIG. 2, the details of the velocity control 9 and the spool drive control 10 are disclosed in greater detail. Wherever appropriate, the symbols used in FIG. 1 are retained in FIG. 2. Thus in the case where the ribbon 1 is traveling in say from left to right, the right step motor 20 operates as the drive motor for taking ribbon onto its associated spool from the spool associated with the left step motor 21. Motor 21 acts as a feedback transducer as will be described shortly. In this instance, the spool drive 10 would comprise the step motor drive 24, reversing switch 35 and the step motor and associated spool 20. The velocity control comprises the programmable interval counter 22, the step counter 23, the left step motor 21 driven as a generator to act as the feedback transducer, the motion detector amplifier 25, pulse counter 26 and the function table 27. The end of travel detector 28 and direction flip-flop 29 comprise part of the spool drive 10 and will be described later.

Figure 3:
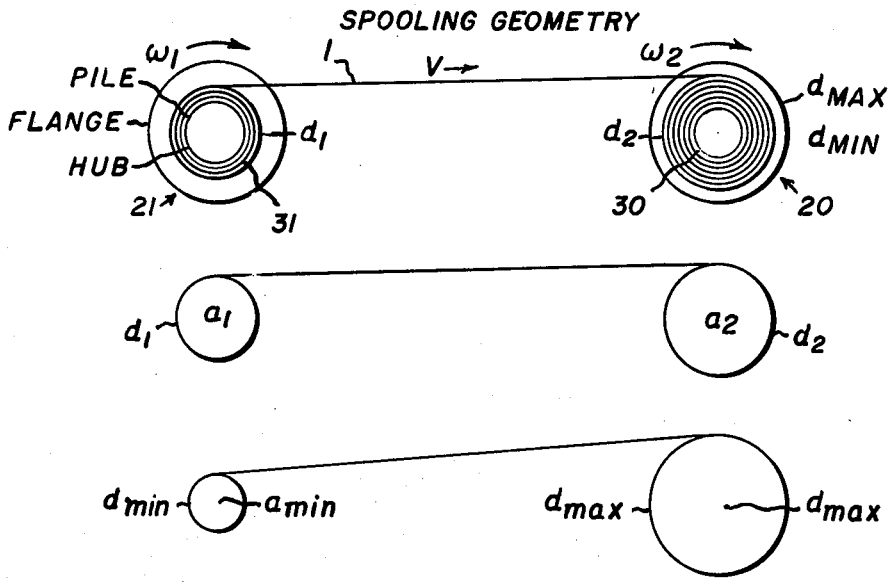
FIG. 3 illustrates graphically certain geometry useful in explaining how the step interval for the takeup spool is related to the displacement of the supply spool.

FIG. 3 illustrates the basic geometry involved in a reeling mechanism. By applying the basic relationships given here an expression for the step angular velocity as a function of the supply spindle angular velocity may be derived. The take-up spool, shown as 20 in FIG. 1, is shown with a substantial amount of ribbon 1 would up on the spool as shown at 30 with a reduced amount of ribbon remaining on the supply spool shown as 31. The diameter of the ribbon on the spool 20 is shown as $d_2$ and the diameter of the ribbon remaining on the spool 31 is shown in $d_1$. The angular velocity of the reels will, of course, vary depending upon the amount of ribbon remaining on the associated spools and this angular velocity changes as the ribbon is being spooled from the supply spool 31 at the desired constant linear velocity onto the take-up spool 20. Obviously because the total mass of ribbon remains constant, the sum of the cross section areas $a_1$ and $a_2$ remains constant. Since area is proportional to the square of the diameter, area being $\pi r^2$, the squares of the diameters remain constant. The linear velocity of the ribbon is equal to radius x angular velocity for either spool. The relationship between the angular velocities of the two spools is thus given as $V=r_1\omega_1=r_2\omega_2$ where $\omega_1$ and $\omega_2$ are the angularvelocities in radians per second of the supply and take-up spools respectively.

Thus, the desired angular velocity $\omega_1$ of the driving spool can be obtained by carrying out the following calculation:

$$\frac{\pi d_1^2}{4} + \frac{\pi d_2^2}{4} = a_1 + a_2 = A \qquad 1.$$

where A is the total area of the piles $$\frac{\pi d_{max}^2}{4} + \frac{\pi d_{min}^2}{4} = a_{max} + a_{min} = A \qquad 2.$$

where $d_{max}$ and $d_{min}$ are the pile diameters of the full and empty spools respectively $$\therefore d_1^2 + d_2^2 = d_{max}^2 + d_{min}^2 \qquad 3.$$

for movement of the ribbon transport $$V = \omega_1 r_1 = \omega_2 r_2 \qquad 4.$$

where V is the ribbon linear velocity, $\omega_1$ is the angular velocity of supply spool 21 and $\omega_2$ is the angular velocity of take-up spool 20 or substituting $$r_1 = V/\omega_1 \text{ and } r_2 = V/\omega_2$$

in equation 3 and solving for $\omega_2$ yields $$\omega_2 = \frac{1}{\sqrt{\frac{1}{V^2}\left(\frac{d_{max}^2}{4} + \frac{d_{min}^2}{4} - \left(\frac{V}{\omega_1}\right)^2\right)}} \qquad 5.$$

From the angular velocity, an expression for the step interval as a function of feedback pulse count accumulated in a drive step sample may be developed as follows:

$$\omega = d\theta/dt$$

where $\theta$ is the angular displacement of a spool spindle. To apply the expression just derived from FIG. 3 to digital control techniques which use discrete increments rather than continuous variables a finite difference expression representing angular velocity of the spools $d\theta/dt$ or $\Delta\theta/\Delta t$ will be used. The value of $\Delta\theta$ for a particular application will be determined by its accuracy and resolution requirements. That is, for a course control employing only a few samples, $\Delta\theta$ would be large and vice versa for a fine control application.

For convenience $\Delta\theta$ shall be designated S and $\Delta t$ shall be designated T. Substituting S/T for $\omega$ in equation 5 gives $$T_2 = \sqrt{S_2^2 \frac{1}{V^2}\left(\frac{d_{max}^2}{4} + \frac{d_{min}^2}{4} - \left(\frac{T_2}{S_1}\right)^2\right)} = \sqrt{\frac{S_2^2\left(\frac{d_{max}^2}{4} + \frac{d_{min}^2}{4}\right)}{V^2\left(1 + \frac{1}{S_1^2}\right)}} \qquad 6.$$

Thus for a step motor control which operates with $S_2$, V, $d_{max}$, $d_{min}$ constant, an expression with constants combined for the period between steps on the drive spool is given by equation $$T_2 = \sqrt{\frac{K}{1 + \frac{1}{S_1^2}}} \qquad 7.$$

where $T_2$ is the step interval for the take up spool 20 and $S_1$ is the displacement of the supply spool 21 for a constant sample interval $S_2$.

Referring to FIG. 2, the function table 27 provides at its output the value of $T_2$ as a function of the feedback sample $S_2$ available from pulse counter 26. Thus, $S_1$ is derived from the feedback signals available from the step motor 21 and $T_2$ is used to drive the step motor 20 for spooling ribbon from the supply reel to the takeup reel. In a given embodiment a microcomputer, such as the well known Intel 8085, was employed for CPU 12. It programmed to generate the three outputs on links 14, 15 and 16 in response to the data supplied by source 13. The data was in the well known serial or parallel ASCI format. The CPU 12 was programmed in a well known manner to respond to the print symbols and function commands available from source 13 to advance the print head 3 under control of carriage 5, to activate desired print wires at the columnar positions defined by carriage control 5 and to provide the velocity clock data to velocity control 7.

Referring to FIG. 2, a reversing switch 35 connects one of the step motors 21 to the motion detector 25 establishing it as the supply spool feedback generator while it connects the other step motor 20 to the step motor driver 24 for control as the takeup spool driver. A polyphase step motor driver 24 responds to step pulses such as shown in FIG. 4*a* available from the carry pulse output of the programmable interval counter 22 to switch the motor windings in a rotating phase sequence to advance the motor in steps in a well known manner. The programmable interval counter 22 has its interval set by the output $T_2$ of the function table 27 every time that it carries. These step pulses from counter 22 are also accumulated by a step counter 23. The count modulus of the step counter 23, therefore, determines the step sample length for which the function table is designed.

Figure 4:
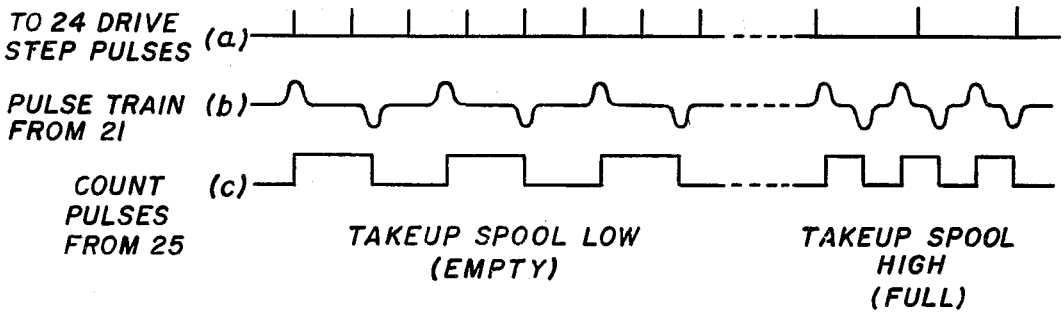
FIG. 4 illustrates graphically certain signals useful in explaining the operation of the present invention.

As the takeup motor 20 is driven, pulling the ribbon, the supply reel motor 21 acts as a permanent magnet alternator. The voltage generated by it as shown in FIG. 4*b* is applied through the reversing switch to a feedback pulse shaper 25 which produces count pulses as shown in FIG. 4*c* at switching logic levels to drive a pulse counter 26. FIG. 4 indicates that as the tape is wound on the take-up spool 20, both the drive step pulse interval and the feedback pulse rate and its resultant pulse count increase to maintain a constant linear velocity of tape movement as governed by the function table 27. The output of the pulse counter 26 addresses the function table 27 with signal $S_1$. A carry pulse at the end of the step sample interval clears the pulse counter 26 over lead 36 from the step counter 23. The pulse counter 26 accumulation, therefore, is a function of the speed ratio of the supply spool to the takeup spool. By placing the count value $S_1$ as derived earlier into the function table 27, the appropriate step interval $T_2$ is continually applied to the interval counter 22 to maintain the ribbon movement at constant velocity.

As the pile on the supply reel 21 decreases while the takeup pile 20 grows, the accumulated pulse count for each step sample increases. To detect the approaching end of the supply pile, an end of travel signal is emitted over lead 37 from the end of travel detector 28 when the pulse count reaches a limit value established in the end of travel detector 28. This end of travel signal complements a direction flip-flop 38 which operates the reversing switch 35 to exchange the roles of the step motors 20 and 21.

Another problem that arises in impact printing through a ribbon is when the ribbon jams or breaks. It is important to stop the printing process and signal an alarm. According to another feature of the present invention, a no pulse detector 50 detects the absence of an output from pulse counter 26 which would arise when the supply spool no longer turns as a result of ribbon jamming or breakage. In this condition no induced EMF is supplied to shaper 25, and hence no counting takes place in counter 26. Upon detecting a no pulse count, detector 50 applies an alarm signal over lead 51 to the microprocessor 12. Microprocessor 12 responds by suspending operation of controls 5, 7 and 9 and hence printing action. Microprocessor 12 also sends an alarm signal to 52 to alert the operator. Thus, the feedback arrangement provided enables a multiplicity of useful functions to be performed and insure adequate printing operation and control.

The velocity reference frequency or clock is supplied over lead 16 from the microprocessor 12 to the programmable interval counter 22 in the velocity control 9. The clock is of a constant frequency for a constant velocity. If ribbon velocity variation is desired, as for example to accommodate a change in desired symbol print rate, the clock frequency in CPU 12 is set by the print rate controller 40. In a particular embodiment, velocity data was a clock operating at 10,000 pulses per second, counter 22 counted a number of clock pulses, say 25, established by value of $T_2$, at end of 25 pulses a carry pulse is emitted which provides a step pulse to driver 24. Counter 23 establishes the sample period $S_2$, for example 75. It produces an output to reset counter 22 and counter 26.

While the system just described could be implemented by common logic elements with a read only memory employed for the function table, it is possible to employ a single chip microprocessor where it is both cost effective and expedient as an alternative to either a large scale integrated circuit or discrete logic elements.

What I claim as new and desire to secure by Letters Patent of the United States is:

1. A tape transport comprising a supply spool and a takeup spool wherein the diameter of the tape being wound on the takeup spool increases as a function of the diameter of the tape being removed from the supply spool, means for transferring tape from the supply spool to the takeup spool at a constant speed comprising a first step and a second step motor, a programmable source of stepping pulses, one of said step motors responsive to said stepping pulses for moving the takeup spool, said other of said step motors responsive to supply spool motion for providing a train of pulses whose rate is proportional to the angular velocity of the supply spool, means for counting said provided train of pulses during a predetermined sample interval, and means responsive to the count of said provided train of pulses to program the occurrences of the stepping pulses provided by said programmable source of stepping pulses.

2. An arrangement according to claim 1 wherein said last named means comprises a storage medium containing predetermined signal values, means responsive to the count of said provided train of pulses to select a predetermined signal value from said medium, means comprising a programmable interval counter responsive to said selected value to provide step pulses having occurrences in accordance with said selected value, and said one of said step motors responsive to said last named stepping pulses for stepping said motor.

3. An arrangement according to claim 2 further comprising a step counter, said step counter being responsive to the occurrences of said stepping pulses to establish the predetermined sample interval.

4. An arrangement according to claim 3 further comprising a reversing switch, and an end of travel detector responsive to a predetermined number of occurrences of pulses in said train of pulses to operate said reversing switch, with said reversing switch coupled to said one and the other of said step motors for causing said other of said step motors to move said takeup spool and said one of said motors in response to tape motion to provide a train of pulses at a rate proportional to its angular velocity.

5. An arrangement according to claim 4 wherein said means comprising a programmable interval counter comprises a reference velocity signal source, and said programmable interval counter responsive to said reference velocity signal and said predetermined signal value for controlling the time rate of occurrences of the stepping pulses during the predetermined sample interval.

6. An arrangement for transferring a web from a supply spool to a takeup spool at a constant speed comprising a first step and a second step motor, a programmable source of stepping pulses, one of said step motors responsive to said stepping pulses for moving the takeup spool, said other of said step motors responsive to supply spool motion for providing a train of pulses at a rate proportional to the angular velocity of said supply spool, means for counting said provided train of pulses during a predetermined sample interval, said programmable source comprising a memory device including a plurality of addressable storage locations each containing a unique stored value relating to required increments of movement of said one of said step motors, means responsive to the count of said provided train of pulses to address a related storage location of said memory device to read the value stored therein, and means responsive to said read storage value for providing said programmable stepping pulses to said one of said step motors.

7. An arrangement for transferring material wound on a supply spool to a takeup spool at a constant speed comprising a step motor and a feedback means, a programmable source of stepping pulses, said step motor responsive to said stepping pulses for moving the takeup spool, said feedback means responsive to motion of said supply spool for providing a train of pulses at a rate proportional to its angular velocity, means for counting said provided train of pulses during a predetermined sample interval, and means responsive to the count of said provided train of pulses to program the occurrences of the stepping pulses provided by said programmed source of stepping pulses.

8. An arrangement according to claim 7 wherein said last named means comprises a storage medium containing predetermined signal values, means responsive to the count of said provided train of pulses to select a predetermined signal value from said medium, means comprising a programmable interval counter responsive to said selected value to provide stepping pulses having occurrences in accordance with said selected value, and said step motor responsive to said last named stepping pulses for stepping said step motor.

9. An arrangement according to claim 8 further comprising a step counter, said step counter being responsive to the occurrences of said stepping pulses to establish the predetermined sample interval.

10. An arrangement according to claim 8 wherein said means comprising a programmable interval counter comprises a reference velocity signal source, and said programmable interval counter responsive to said reference velocity signal and said predetermined signal values for controlling the time rate of occurrences of the stepping pulses during the predetermined sample interval.

11. An arrangement for linearly moving at a predetermined velocity material circularly wound on a first carrier to a second carrier for circular winding thereon, first means operating as a drive means and a second means operating as a feedback means, a programmable source of stepping pulses, said first means responsive to said stepping pulses for moving the second carrier, said second means responsive to motion of said first carrier for providing a train of pulses at a rate proportional to the angular velocity of said first carrier, means for counting said provided train of pulses during a predetermined sample interval, and means responsive to the count of said provided train of pulses to program the occurrences of the stepping pulses provided by said programmed source of stepping pulses to said first means to move said material linearly at said predetermined velocity.

12. An arrangement according to claim 11 further comprising a reversing means coupled to said first and second means, and a material travel detector responsive to a predetermined number of occurrences of pulses in said train of pulses to operate said reversing means to reverse the functions of said first and second means.

13. An arrangement according to claim 12 comprising means for changing the value of said predetermined velocity, said means comprising a reference velocity signal source, means for changing said reference velocity, and said programmable means responsive to said changed reference velocity signal for changing the time rate of occurrences of the stepping pulses during the predetermined sample interval.

14. An arrangement for transferring material wound on a supply spool to a takeup spool at a constant speed comprising a step motor and a feedback means, a programmable source of stepping pulses, said step motor responsive to said stepping pulses for moving the takeup spool, said feedback means responsive to motion of said supply spool for providing a train of pulses at a rate proportional to its angular velocity, means for counting said provided train of pulses during a predetermined sample interval, means responsive to the count of said provided train of pulses to program the occurrences of the stepping pulses provided by said programmed source of stepping pulses, and means responsive to the absence of a pulse count from said counting means during said predetermined sample interval for terminating the programming of stepping pulses by said programmable source.

15. An arrangement according to claim 14 further comprising said programmable source responsive to the absence of a pulse count from said pulse counter to provide an alarm signal.

* * * * *